US007264131B2

(12) United States Patent
Tsutsumi et al.

(10) Patent No.: US 7,264,131 B2
(45) Date of Patent: Sep. 4, 2007

(54) SYNTHETIC RESIN CAP, CLOSING DEVICE, AND CONTAINER-FILLED BEVERAGE

(75) Inventors: Hiroaki Tsutsumi, Chiba (JP); Mitsuharu Harada, Tsukuba (JP); Masataka Hisano, Oyama (JP)

(73) Assignee: Alcoa Closure Systems Japan, Limited, Shimotsuga-gun, Tochigi-ken (JP)

( * ) Notice: Subject to any disclaimer, the term of this patent is extended or adjusted under 35 U.S.C. 154(b) by 0 days.

(21) Appl. No.: 10/506,398

(22) PCT Filed: Mar. 3, 2003

(86) PCT No.: PCT/JP03/02439

§ 371 (c)(1),
(2), (4) Date: May 11, 2005

(87) PCT Pub. No.: WO03/074380

PCT Pub. Date: Sep. 12, 2003

(65) Prior Publication Data

US 2005/0211659 A1 Sep. 29, 2005

(30) Foreign Application Priority Data

Mar. 4, 2002 (JP) ..... 2002-057617

(51) Int. Cl.
*B65D 53/00* (2006.01)

(52) U.S. Cl. ..... 215/344; 215/252; 220/296

(58) Field of Classification Search ..... 215/252, 215/258, 344, 343, DIG. 1; 220/296, 303; *B65D 41/04*
See application file for complete search history.

(56) References Cited

U.S. PATENT DOCUMENTS 4,442,947 A * 4/1984 Banich, Sr. ..... 215/344
5,257,705 A * 11/1993 de Santana ..... 215/252
6,068,151 A * 5/2000 Recendez M. ..... 215/252
6,126,027 A * 10/2000 Thompson ..... 215/354
6,325,225 B1 * 12/2001 Druitt et al. ..... 215/252

(Continued)

FOREIGN PATENT DOCUMENTS

CN 1231641 A 10/1999

(Continued)

OTHER PUBLICATIONS

The Text of the First Office Action by Chinese Patent Office on Jul. 21, 2006.

*Primary Examiner*—Lien M. Ngo
(74) *Attorney, Agent, or Firm*—Knobbe Martens Olson & Bear LLP

(57) ABSTRACT

One embodiment provides a synthetic resin cap comprising a cap body and a circular inner seal projection. The cap body having a top plate and a cylindrical section extending downward from the periphery thereof, and a threaded section that engages with a thread of the container opening is formed in the inner peripheral surface of the cylindrical section. The inner seal projection formed on the inner surface of the top plate and fits into a container opening. The circumferential direction forming angle of the threaded section is from 600° to 720°, and the threaded section is divided into a plurality of divided threaded sections at divided sections; and the divided sections are provided at nearly equal intervals in the circumferential direction.

9 Claims, 6 Drawing Sheets

U.S. PATENT DOCUMENTS

| | | | | |
|---|---|---|---|---|
| 6,325,226 | B1 * | 12/2001 | Krautkramer | 215/252 |
| 6,338,414 | B1 * | 1/2002 | Schellenbach | 215/252 |
| 6,679,395 | B1 * | 1/2004 | Pfefferkorn et al. | 215/307 |
| 6,779,672 | B2 * | 8/2004 | Kano et al. | 215/344 |
| 2001/0027957 | A1 | 10/2001 | Yuji et al. | |
| 2001/0030164 | A1 | 10/2001 | Corvaglia | |

FOREIGN PATENT DOCUMENTS

| | | | |
|---|---|---|---|
| DE | 4203238 | * | 8/1993 |
| EP | 0644125 | | 3/1995 |
| EP | 1327587 | * | 7/2003 |
| JP | 08034455 | | 6/1996 |
| JP | 2001-114310 A | | 4/2001 |
| JP | 2001-122302 A | | 5/2001 |
| WO | WO 00/56618 | | 9/2000 |

* cited by examiner

"Prior Art"

SYNTHETIC RESIN CAP, CLOSING DEVICE, AND CONTAINER-FILLED BEVERAGE

TECHNICAL FIELD

This invention relates to a synthetic resin cap that is attached to a container opening and seals the container opening, a closing device using the synthetic resin cap, and a container-filled beverage.

The present specification is based on a Japanese Patent Application (No. 2002-57617), and incorporates some of the contents of that Japanese Application.

BACKGROUND ART

FIG. 6 shows one example of a conventional synthetic resin cap, in which a synthetic resin cap 41 comprises a cap body 4 composed of a top plate 2 and a cylindrical section 3 extending downward from its periphery.

The cylindrical section 3 is divided by a horizontal score 6 into a main section 8 and a TE ring section 9, which is connected to the bottom edge of the main section 8 by bridges 7.

A circular inner seal projection 12 fits into a container opening, and protrudes from the inner surface of the top plate 2.

A threaded section 40 that engages with a thread of the container opening is formed in the inner peripheral surface of the main section 8. The circumferential direction forming angle of the threaded section 40, i.e. the angle from the top section 40*a* to the bottom section 40*b*, is generally set at approximately 540° (approximately 1.5 times the circumference).

In the cap 41, the threaded section 40 is divided into a plurality of divided threaded sections 42 and 43 in the lengthwise direction.

In the cap 41, divided sections 44 divide the threaded section 40 into the divided threaded sections 42 and 43, and are provided only at sections where the threaded section 40 is formed in two steps. That is, the threaded section 40 comprises one long divided threaded section 42 that is formed in one step, and a plurality of short divided threaded sections 43 that are formed in two steps.

In manufacturing the cap 41, synthetic resin material is generally pressure-molded by using molds for outer surface and inner surface, the molded cap 41 being removed from the mold for outer surface, and the mold for inner surface being peeled away from the cap 41.

In the conventional cap 41, since the divided threaded sections 42 and 43 have different lengths and numbers of formation, the strength of the threaded section 40 at the section where the divided threaded section 42 is formed differs from its strength at the sections where the divided threaded sections 43 are formed.

As a consequence, when a container which the cap 41 is attached to has high internal pressure (e.g. when the cap 41 has been attached to a container filled with a fizzy beverage, or when, after removing the cap 41 and then reattaching it, the contained liquid has fermented, and other such cases), the weaker divided threaded section 42 of the threaded section 40 will not mesh adequately with the thread of the container opening, making the cap 41 unable to be attached properly and reducing its hermeticity.

Furthermore, since the strength of the threaded section 40 of the cap 41 inclines in the circumferential direction, at the time of molding, and particularly at the time of peeling away the mold for inner surface from the cap 41, the cap 41 may become tilted with respect to the mold for inner surface, applying an excessive force against part of the threaded section 40 and causing this part to deform. When such deformation has occurred, the cap 41 cannot be attached properly and its hermeticity decreases.

SUMMARY OF CERTAIN ASPECTS OF THE INVENTION

One embodiment provides a synthetic resin cap that is capable of maintaining high hermeticity.

In one embodiment, the synthetic resin cap is configured that a circular inner seal projection that fits into a container opening is formed on the inner surface of a top plate of a cap body composed of a top plate and a cylindrical section extending downward from its periphery, and a threaded section that engages with a thread of the container opening is formed in the inner peripheral surface of the cylindrical section; the circumferential direction forming angle of the threaded section is from 600° to 720°, and the threaded section is divided into a plurality of divided threaded sections at divided sections; and the divided sections are provided at nearly equal intervals in the circumferential direction.

In another embodiment, the synthetic resin cap can be configured so that the divided threaded section, which is immediately below the divided threaded section at the nearest position to the top plate, and the divided threaded section, which is immediately above the divided threaded section at the farthest position from the top plate, are formed continuously.

In another embodiment, he synthetic resin cap can be configured so that a circular opening seal projection that contacts an opening edge of the container opening is formed on the top plate, and, when the synthetic resin cap is attached to the container opening, the opening edge seal projection is made able to bend and be deformed in the expanding radial direction until it contacts the cap body.

Another embodiment provides a closing device, which comprises a container and a synthetic resin cap that is fitted into an opening of the container, the synthetic resin cap being configured that a circular inner seal projection that fits into the container opening is formed on the inner surface of a top plate of a cap body, provided with the top plate and a cylindrical section extending downward from its periphery, and a threaded section that engages with a thread of the container opening is formed in the inner peripheral surface of the cylindrical section; the threaded section having a circumferential direction forming angle of from 600° to 720°, and being divided into a plurality of divided threaded sections at divided sections; the divided sections being provided at nearly equal intervals in the circumferential direction.

Still another embodiment provides a container-filled beverage, which comprises a beverage that is filled inside a closing device provided with a container and a synthetic resin cap that is fitted into an opening of the container, and is configured that a circular inner seal projection that fits into the container opening is formed on the inner surface of a top plate of a cap body, provided with the top plate and a cylindrical section extending downward from its periphery, and a threaded section that engages with a thread of the container opening is formed in the inner peripheral surface of the cylindrical section; the threaded section having a circumferential direction forming angle of from 600° to 720°, and being divided into a plurality of divided threaded sections at divided sections; the divided sections being provided at nearly equal intervals in the circumferential direction.

DETAILED DESCRIPTION OF CERTAIN INVENTIVE EMBODIMENTS

Figure 1:
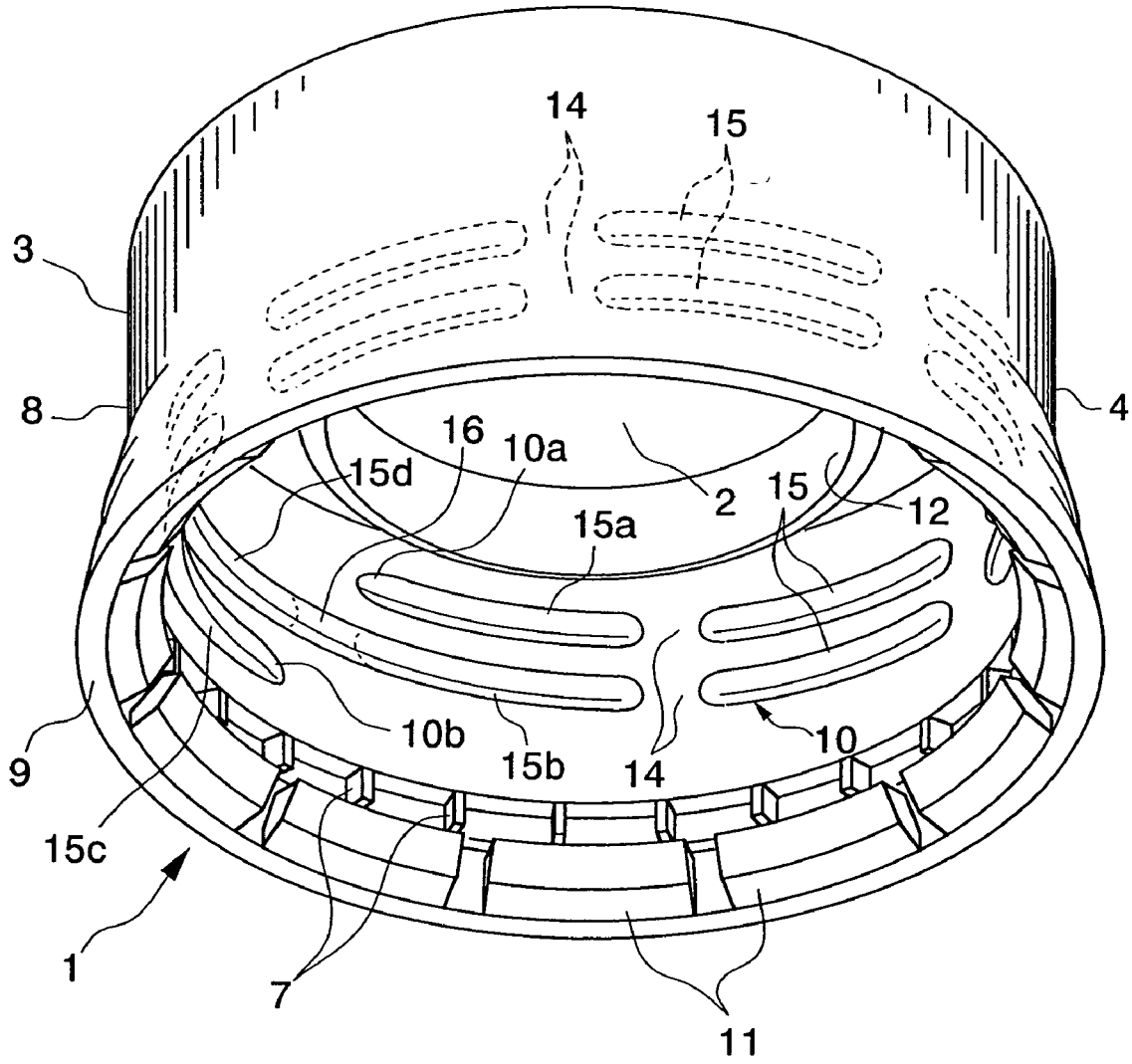
FIG. 1 is a perspective view showing the schematic constitution of a synthetic resin cap according to a first embodiment of the present invention.
Figure 2A:
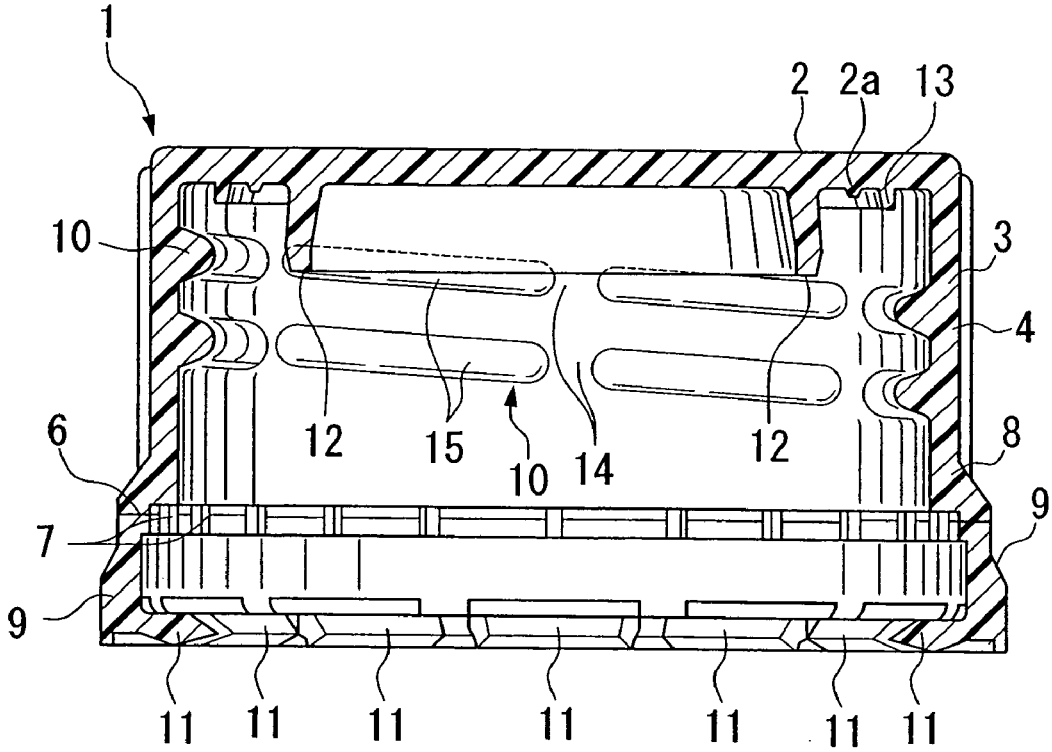
FIG. 2A is a cross-sectional view showing the entire synthetic resin cap shown in FIG. 1.

FIG. 1 and FIG. 2A show an example of the synthetic resin cap according to a first embodiment of this invention.

Figure 2B:
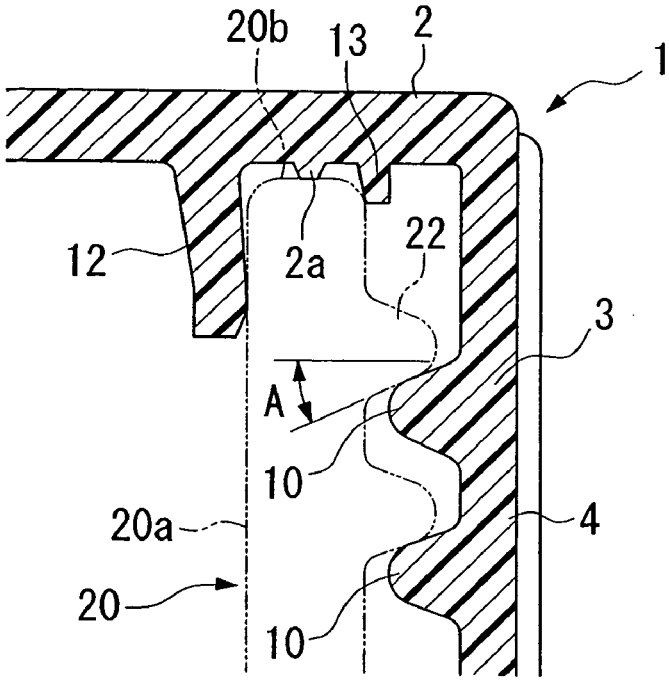
FIG. 2B is a diagram showing the state when the synthetic resin cap of FIG. 1 has been attached to a container opening.

FIG. 2B shows an embodiment of the closing device of this invention, the closing device shown here comprising a container, and a synthetic resin cap 1 that is attached to an opening 20 of the container.

In one embodiment, the cap 1 shown here is a type known as a one-piece cap, and includes a cap body 4 comprising a disk-like top plate 2 and a cylindrical section 3 that extends downward from its periphery.

The cylindrical section 3 is divided by a horizontal score 6 (weakening line) into a main section 8 and a tamper evidence ring section 9 (TE ring section), which is connected to the bottom edge of the main section 8 by a great number of narrow bridges 7.

A circular inner seal projection 12 fits into the container opening 20, which the cap 1 is attached to, and protrudes downward from the inner surface of the top plate 2.

When fitted into the container opening 20, the inner seal projection 12 contacts the inner peripheral surface 20*a* of the container opening 20 without a gap, enabling the container opening 20 to be hermetically sealed.

In one embodiment, the protruding length of the inner seal projection 12 should be from 1 mm to 5 mm. In one embodiment, the maximum outer diameter of the inner seal projection 12 should preferably be set to approximately equal to, or slightly larger than, the inner diameter of the container opening 20.

An opening edge seal projection 13 that contacts the outer peripheral surface of the container opening 20, and an opening edge contacting projection 2*a* that contacts the opening edge 20*b*, are formed on the inner surface of the top plate 2.

Tabs 11 are provided on the inner face of the TE ring section 9. Tabs 11 are a plurality of thin plate-like clipping means for preventing the movement of the TE ring section 9 by clipping with the container when the cap 1 is disconnected. In one embodiment, the tabs 11 are plate-like and are able to rise and fall.

A threaded section 10 is provided on the inner peripheral surface of the main section 8, and engages with a threaded section 22 that is provided in the outer periphery of the container opening 20.

In one embodiment, the circumferential direction forming angle of the threaded section 10 from its top edge 10*a* to its bottom edge 10*b* should be from 600° to 720° (preferably from 640° to 720°, and ideally from 680° to 720°)

In the example shown here, the circumferential direction forming angle of the threaded section 10 is approximately 720° (approximately two times the circumference).

In another embodiment, the circumferential direction forming angle of the threaded section 10 can be from 600° to 760° (preferably from 600° to 800°, and ideally from 600° to 840°).

When the circumferential direction forming angle of the threaded section 10 is less than this range, the strength of the threaded section 10 inclines in the circumferential direction, and consequently, when the internal pressure rises in the container which the cap 1 is attached to, the weaker threaded section 10 (the section forming one step) will not engage adequately with the thread 22 of the container opening 20, making the cap 1 unable to be attached properly and potentially reducing its hermeticity.

Furthermore, since the strength of the threaded section 10 inclines in the circumferential direction, at the time of molding, and particularly at the time of peeling away the mold for inner surface from the cap 1, the cap 1 may become tilted with respect to the mold for inner surface, applying an excessive force against part of the threaded section 10 and making this part likely to deform.

When the circumferential direction forming angle exceeds the above range, at a time of high pressure inside the container, the strength of the threaded section 10 inclines in the circumferential direction, whereby the threaded section 10 and the threaded section 22 do not engage adequately, which may reduce hermeticity.

Furthermore, at the time of molding, and particularly at the time of peeling away the mold for inner surface from the cap 1, an excessive force applies against part of the threaded section 10, making this part of the threaded section 10 likely to deform. Since the circumferential direction forming angle of the threaded section 10 increases, it becomes troublesome to disconnect the cap 1.

The threaded section 10 is divided into a plurality of divided threaded sections 15 in its lengthwise direction.

Divided sections 14 are provided at nearly equal intervals in the circumferential direction.

In one embodiment, the circumferential direction forming angle of the divided sections 14 should be greater than 45°, since this increases the strength of the divided threaded sections 15 and makes it possible to prevent deforming at the time of molding. When the circumferential direction forming angle is less than the above range, the strength of the divided threaded sections 15 decreases, and, at the time of molding, and particularly at the time of peeling away the mold for inner surface from the cap 1, the mold may deform the divided threaded sections 15.

In the example shown here, the divided sections 14 are provided at approximately every 60° in the circumferential direction.

In one embodiment, the interval between the divided sections 14 in the circumferential direction should preferably be no greater than 90°. When the circumferential direction interval exceeds this, at the time of molding, and particularly at the time of peeling away the mold for inner surface from the cap 1, the mold applies an excessive force to the threaded section 10 making it likely to deform.

As shown in FIG. 1, the divided threaded section 15*b*, which is immediately below the divided threaded section 15*a* at the nearest position to the top plate 2 (the highest position), and the divided threaded section 15*d*, which is immediately above the divided threaded section 15*c* at the farthest position from the top plate 2 (the lowest position), should be formed continuously without being divided.

In other words, the ends of the divided threaded sections 15*b* and 15*d* should be connected by a connecting section 16.

In one embodiment, the divided threaded sections 15*b* and 15*d* may be divided instead.

In one embodiment, as shown in FIG. 2B, the formation angle A of the top surface of the threaded section 10 with respect to the horizontal face (the face parallel to the top plate 2) should be from 20° to 45° (preferably from 20° to 30°). By setting the formation angle A within the above range, the contact area between the top surface of the threaded section 10 and the bottom surface of the threaded section 22 can be made larger.

Generally, when a large force is additionally applied in the tightening direction after tightening the cap to the container opening, the cylindrical section is liable to deform in the expanding radial direction along the bottom surface of the thread.

To prevent this, in this cap 1, the formation angle A is set within the above range, thereby increasing the contact area between the top surface of the threaded section 10 and the bottom surface of the threaded section 22 so that, even when a large force is applied in the tightening direction, it is possible to prevent a frictional force increasing between the threaded sections 10 and 22, and prevent the cylindrical section 3 from deforming in the expanding radial direction.

When the formation angle A is below the above range, at the time of molding, and particularly at the time of peeling away the mold for inner surface from the cap 1, a large force is applied to the threaded section 10 making deformation likely.

When the formation angle A is greater than the above range, in the case where a large force is additionally applied in the tightening direction after tightening the cap to the container opening, or the case where the pressure inside the container has risen, the cylindrical section 3 is liable to deform in the expanding radial direction along the bottom surface of the thread 22.

Subsequently, the operation of the cap 1 when attaching it to the container opening 20 will be explained.

As shown in FIG. 2B, when the cap 1 is wound and tightened around the container opening 20, the inner seal projection 12 fits into the container opening 20 and contacts the inner peripheral surface 20*a* of the container opening 20 without a gap At the stage where the opening edge 20*b* of the container opening 20 has reached the projection 2*a* of the top plate 2, the entire length of the threaded section 10 from the top edge 10*a* to the bottom edge 10*b* contacts the threaded section 22 from below (see the state shown in FIG. 2B).

In this state, the threaded section 22 causes a downward (diagonally downward) resisting force to act against the threaded section 10.

In this cap 1, since the circumferential direction forming angle of the threaded section 10 is from 600° to 720°, the force applied by the threaded section 22 to the threaded section 10 acts evenly throughout a wide area in the cap circumferential direction.

For example, as shown in FIG. 2B, since the circumferential direction forming angle of the threaded section 10 is approximately 720 (approximately twice the circumference), the resisting force acting on the threaded section 10 is even nearly all the way around the perimeter.

In manufacturing the cap 1, a synthetic resin material is generally pressure-molded by using metal molds for outer surface and inner surface, the molded cap 1 being removed from the mold for outer surface, and the mold for inner surface can be peeled away from the cap 1.

A metal mold having the same shape as the inner surface of the cap 1 is used as the mold for inner surface. In this metal mold for inner surface, a threaded section formation groove is formed along the shape of the threaded section 10.

When peeling the mold for inner surface from the cap 1, the threaded section formation groove applies a force against the threaded section 10 in the peeling direction.

In this cap 1, since the circumferential direction forming angle of the threaded section 10 is from 600° to 720°, the force applied by the mold for inner surface against the threaded section 10 acts evenly throughout a wide area in the cap circumferential direction.

In the example shown in FIG. 2B, since the circumferential direction forming angle of the threaded section 10 is approximately 720° (approximately twice the circumference), the force acting on the threaded section 10 is even nearly all the way around the perimeter.

When the cap 1, which has been attached to the container opening 20, is rotated in the disconnecting direction, the great number of tabs 11 that are provided on the inner surface of the TE ring section 9 clip to the container opening 20, making the main section 8 of the cap body 4 rise as the cap 1 is rotated and stopping the TE ring section 9 from moving upwards. Consequently, an expanding force acts on the bridges 7 that are connecting the cap main section 8 to the TE ring section 9, thereby breaking the bridges 7, cutting away the TE ring section 9 from the main section 8, and opening the cap 1.

In the cap 1 of this embodiment, the circumferential direction forming angle of the threaded section 10 is from 600° to 720°, and the threaded section 10 is divided into a plurality of divided threaded sections 15 at the divided sections 14, the divided sections 14 being provided at nearly equal intervals in the circumferential direction; therefore, the strength of the threaded section 10 is made uniform in the circumferential direction, and the resisting force applied to the threaded section 10 by the threaded section 22 can be made to act evenly throughout a wide area in the circumferential direction.

As a consequence, when a container which the cap 1 is attached to has high internal pressure (e.g. when the cap 1 has been attached to a container filled with a fizzy beverage, or when, after disconnecting the cap 1 and then reattaching it, the contained liquid has fermented, and other such cases), the engaging state between the threaded section 10 and the threaded section 22 can be prevented from locally deteriorating.

Therefore, the cap 1 can be kept properly attached, preventing its hermeticity from decreasing.

Furthermore, since the strength of the threaded section 10 can be made uniform in the circumferential direction, at the time of molding, and particularly at the time of peeling away the metal mold for inner surface from the cap 1, the mold for inner surface can be prevented from becoming tilted with respect to the cap 1, and the force applied against the threaded section 10 in the peeling direction by the threaded section formation groove can be made to act evenly in a wide area in the cap circumferential direction.

For these reasons, the force in the peeling direction can be prevented from acting greatly on the cap locally, preventing the threaded section 10 from deforming.

Therefore, reduction in hermeticity caused by this deforming can be prevented.

Furthermore, since the divided threaded section 15*b*, which is immediately below the divided threaded section 15*a* at the nearest position to the top plate 2 (the highest position), and the divided threaded section 15*d*, which is immediately above the divided threaded section 15*c* at the farthest position from the top plate 2 (the lowest position), are formed continuously, the following effects, according to this embodiment, can be obtained.

At the cylindrical section 3 near the section where the divided threaded section 15*c*, which is at the lowest position, and the divided threaded section 15*d*, which is immediately above it, are formed, there is a long distance from the top plate 2 to the divided threaded section 15*d*.

Since the cylindrical section 3 at this section has a large section that does not engage with the threaded section 22 (the section from the top plate 2 to the divided threaded section 15*d*), when the internal pressure of the container, which the cap 1 is attached to, has increased, it is easy to expand and deform in the expanding radial direction.

On the other hand, at the cylindrical section 3 near the section where the divided threaded section 15*a*, which is at the highest position, and the divided threaded section 15*b*, which is immediately below it, are formed, the section that does not engage with the threaded section 22 (the section from the top plate 2 to the divided threaded section 15*a*) is small; consequently, even when the internal pressure of the container, which the cap 1 is attached to, has increased, it is unlikely to expand and deform in the expanding radial direction.

In the cap 1, since the divided threaded section 15*d* is formed continuously to the divided threaded section 15*b* that is formed in the cylindrical section 3 at the section which does not easily deform, it is not easy to move the divided threaded section 15*d* in the expanding radial direction, enabling the cylindrical section 3 near the section where the divided threaded section 15*d* is formed to be prevented from expanding and deforming.

Therefore, even when the pressure inside the container which the cap 1 has been attached to has increased, the cap 1 can be kept properly attached, preventing its hermeticity from decreasing.

Figure 3:
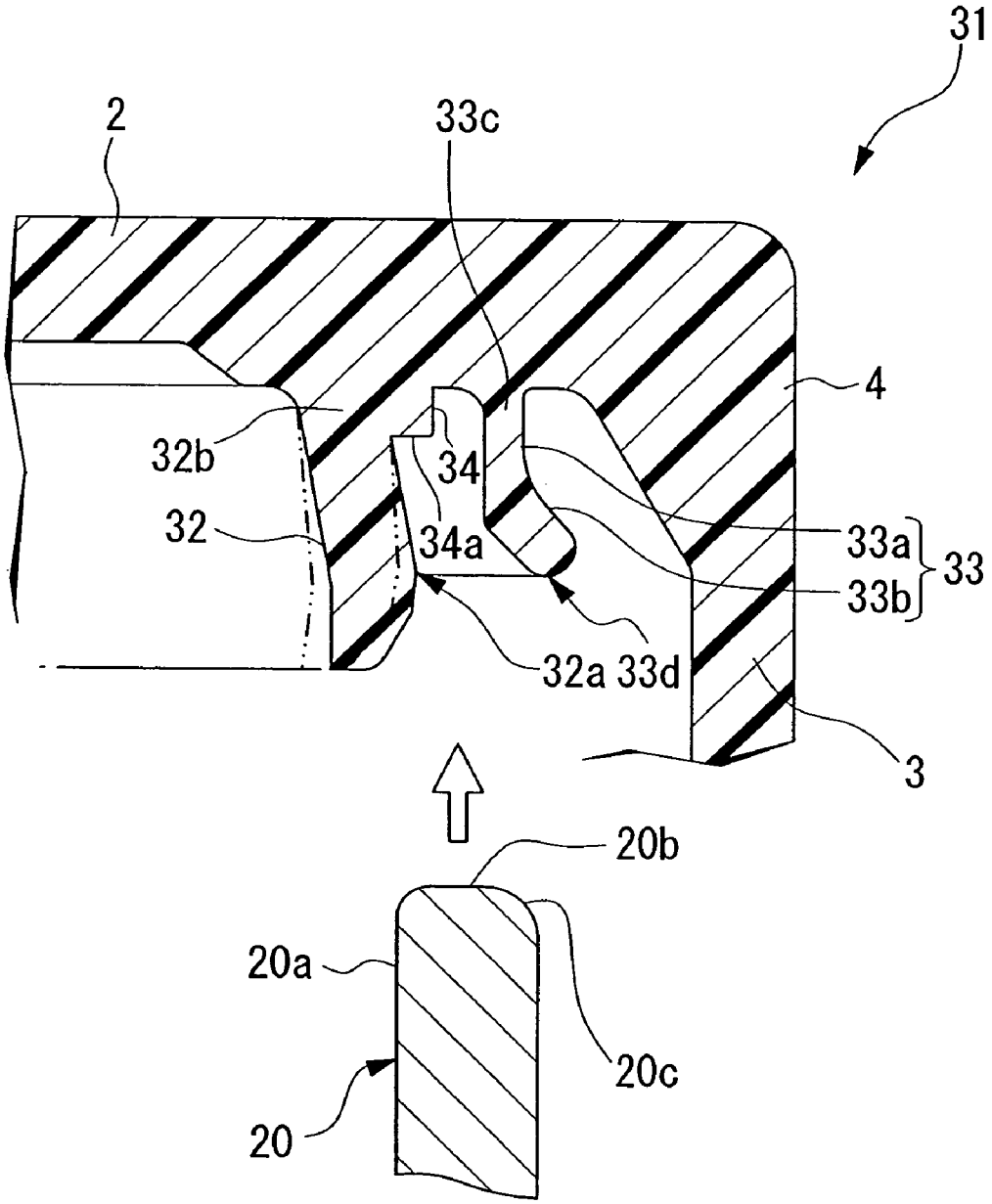
FIG. 3 is a cross-sectional view showing primary parts of the synthetic resin cap according to a second embodiment of this invention.

FIG. 3 shows a second embodiment of the synthetic resin cap of this invention, the synthetic resin cap 31 shown here comprising a circular inner seal projection 32, which fits into the container opening 20, and a circular opening edge seal projection 33, which contacts the opening edge 20*b* of the container opening 20 (in particular the outer peripheral edge 20*c*), the inner seal projection 32 and the opening edge seal projection 33 being formed on the inner surface of the top plate 2 of cap body and protruding downward from it.

Preferably, the diameter of the inner seal projection 32 gradually increases in the protruding direction (downward), so that the outer diameter of its maximum outer diameter section 32*a* is greater than the inner diameter of the container opening 20.

The opening edge seal projection 33 seals the opening edge 20*b* of the container opening 20 (particularly the outer peripheral section 20*c*), and has an erect cylindrical section 33*a*, which extends nearly vertically downward from the inner surface of the top plate 2, and a skirt-like expanding cylindrical section 33*b*, which widens in diameter downwards from the bottom edge of the erect cylindrical section 33*a*.

In one embodiment, the projection length of the opening edge seal projection 33 should be from 1 mm to 4 mm (preferably from 1.5 mm to 3 mm).

In one embodiment, the length of the erect cylindrical section 33*a* should be from 0.5 mm to 3 mm (preferably from 1 mm to 2 mm), and its thickness should be from 0.1 mm to 1 mm (preferably from 0.2 mm to 0.5 mm).

In one embodiment, the length of the expanding cylindrical section 33*b* should be from 0.5 mm to 3 mm (preferably from 1 mm to 2 mm), and its thickness should be set greater than the thickness of the erect cylindrical section 33*a*, more specifically, from 0.2 mm to 1.5 mm (preferably from 0.4 mm to 1 mm).

In one embodiment, the gradient angle of the expanding cylindrical section 33*b* with respect to the vertical direction should be from 20° to 60°.

The opening edge seal projection 33 is capable of bending and deforming in the expanding radial direction at the base section 33*c* of the erect cylindrical section 33*a*.

The inner diameter of the erect cylindrical section 33*a* is set smaller than the outer diameter of the container opening 20.

In one embodiment, the diameter of the bottom edge 33*d* of the expanding cylindrical section 33*b* should be set larger than the outer diameter of the container opening 20.

A positioning protrusion 34 is provided on the top plate 2, and contacts the opening edge 20*b* of the container opening 20.

The positioning protrusion 34 is provided in order to keep the distance between the top plate 2 and the opening edge 20*b* approximately constant, and to keep the wind tightening angle approximately constant when attaching the cap; therefore, the positioning protrusion 34 is substantially rectangular in cross-section and protrudes downwards.

The positioning protrusion 34 is formed in a single piece with the inner seal projection 32 on the outer surface side thereof.

The positioning protrusion 34 is provided at a position where its bottom face 34*a* will contact the opening edge 20*b* when the cap 31 is attached to the container opening 20.

Next, the operation of the cap 31 when it is attached to the container opening 20 will be explained with reference to FIGS. 3 to 5.

Figure 4:
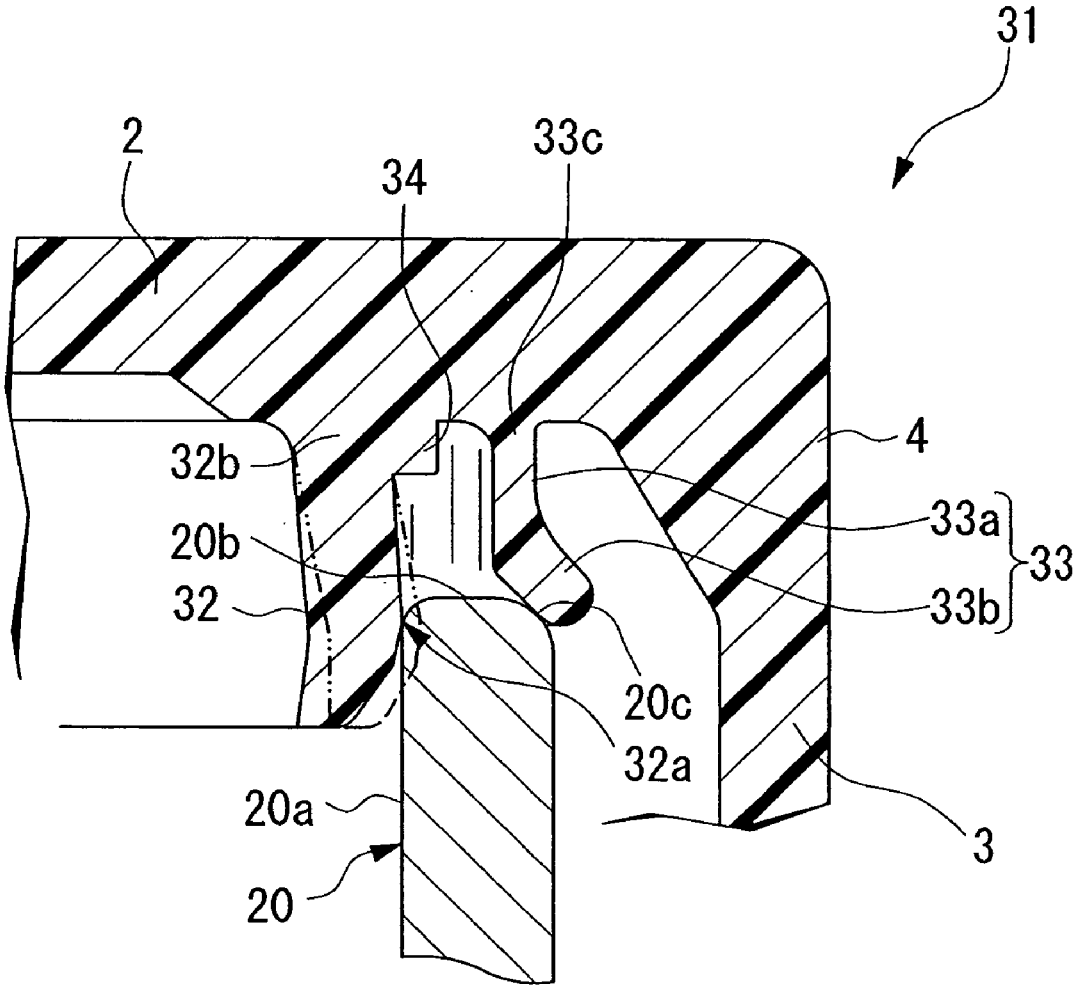
FIG. 4 is a diagram showing a step of attaching the synthetic resin cap shown in FIG. 3.

As shown in FIGS. 3 and 4, when the cap 31 is wound and tightened around the container opening 20, the inner seal projection 32 fits into the container opening 20 and contacts the inner peripheral surface 20*a* of the container opening 20 without a gap.

In compliance with the rotation of the cap 31, the outer peripheral section 20*c* of the opening edge 20*b* of the container opening 20 contacts the inner surface of the expanding cylindrical section 33*b* of the opening edge seal projection 33, applying an upward force against it (see FIG. 3).

As a result of the application of the upward force of the container opening 20 against the expanding cylindrical section 33*b*, a force in the expanding radial direction is applied against the opening edge seal projection 33, whereby the opening edge seal projection 33 bends and deforms at its base 33*c* in the expanding radial direction.

Figure 5:
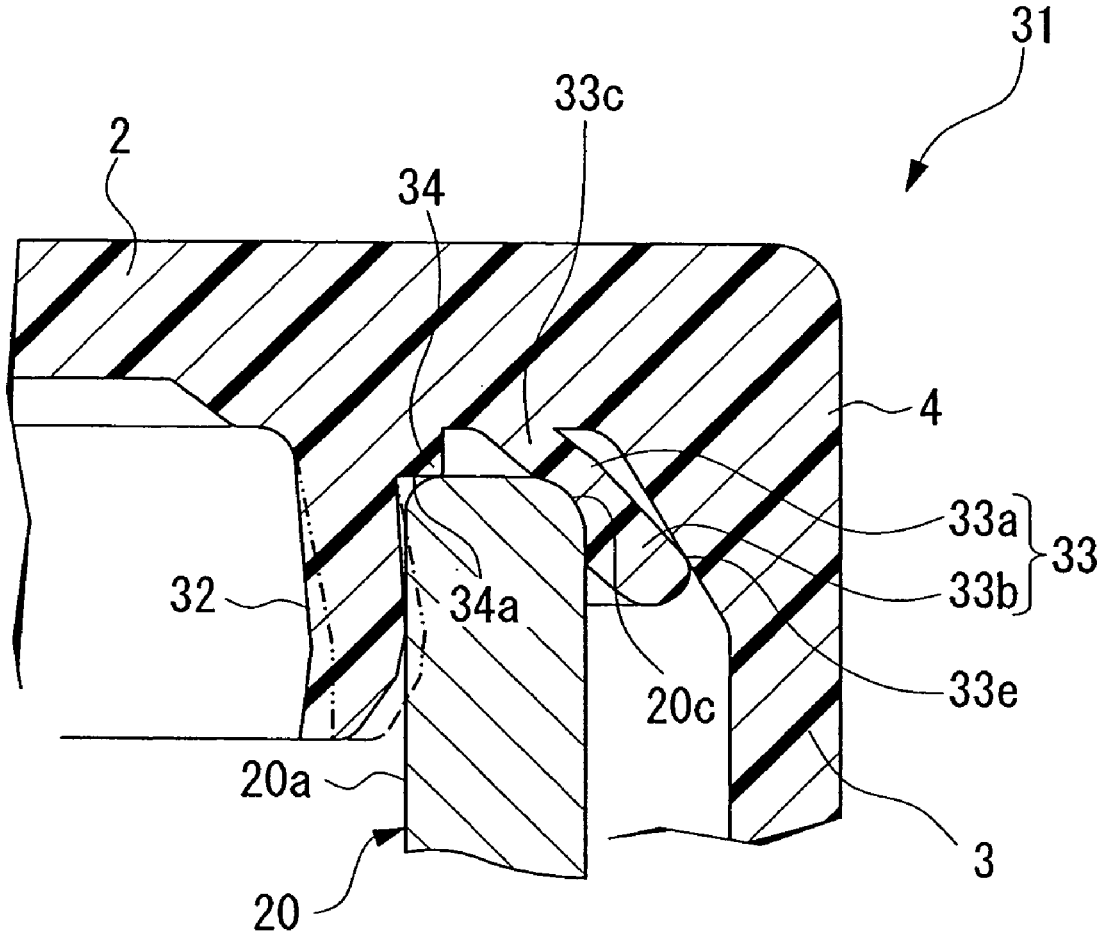
FIG. 5 is a diagram showing a step of attaching the synthetic resin cap shown in FIG. 3.
Figure 6:
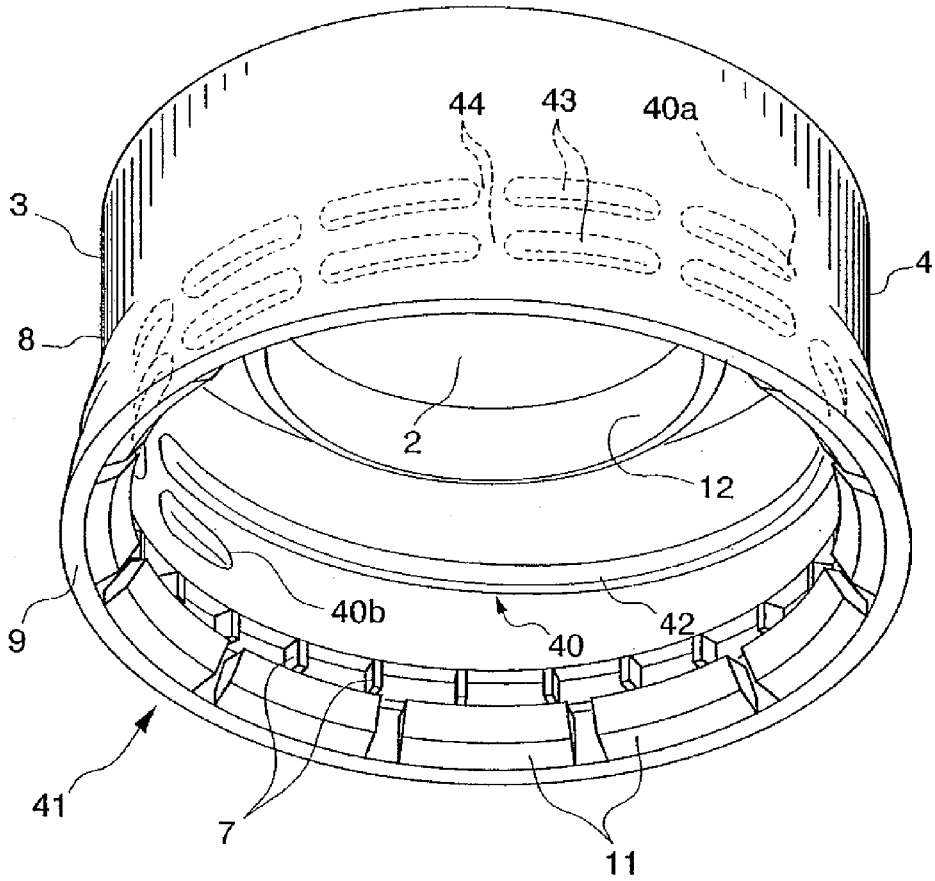
FIG. 6 is a perspective view of the schematic constitution of a conventional synthetic resin cap.

As shown in FIG. 5, when the cap 31 is further rotated, the container opening 20 causes the opening edge seal projection 33 to bends and deform further in the expanding radial direction, and the tip 33*e* contacts the cap body 4.

In this state, the outer peripheral section 20*c* of the opening edge 20*b* applies a diagonally upward pressing force against the erect cylindrical section 33*a*, and in addition, the cap body 4 applies a diagonally downward resisting force against the expanding cylindrical section 33*b*, whereby the opening edge seal projection 33 slightly bends and deforms in the midsection of the long direction so as to jut outward.

Consequently, the opening edge seal projection 33 bends and deforms outwardly at the base 33*c*, and bends and deforms outwardly at the midsection of the long direction.

Therefore, the elastic restoring force pushes the opening edge seal projection 33 against the outer peripheral section 20*c* so that the opening edge seal projection 33 contacts the outer peripheral section 20*c* without a gap, thereby sealing the container opening 20.

At this time, since the opening edge seal projection 33 does not contact the entire opening edge 20*b* but only a narrow area including the outer peripheral section 20*c*, the force applied against the opening edge 20*b* by the opening edge seal projection 33 is concentrated near the outer peripheral section 20*c*.

In the state shown in FIG. 5, the opening edge 20*b* of the container opening 20 is contacting the bottom surface 34*a* of the positioning protrusion 34.

This positions the height of the cap 31 with respect to the opening edge 20*b*, and obtains a predetermined distance between the top plate 2 and the opening edge 20*b*.

Consequently, the deformation amount of the opening edge seal projection 33 reaches a predetermined value, and so does the pressing force of the opening edge seal projection 33 against the opening edge 20*b*.

By the above steps, the cap 31 is attached to the container opening 20.

In one embodiment, the container can be filled with a beverage such as fruit juice, tea, coffee, and the like, so that by attaching the cap 31 to the container opening 20 it is possible to obtain a container-filled beverage.

As described above, in various embodiments, the circumferential direction forming angle of the threaded section is from 600° to 720°, the threaded section is divided into a plurality of divided threaded sections at the divided sections, and the divided sections are provided at nearly equal intervals in the circumferential direction; therefore, the strength of the threaded section is made uniform in the circumferential direction, and the resisting force applied to the threaded section by the threaded section of the container opening can be made to act evenly throughout a wide area in the circumferential direction.

As a consequence, when the container, which the cap is attached to, has high internal pressure (e.g. when the cap has been attached to a container filled with a fizzy beverage, or when, after disconnecting the cap and then reattaching it, the contained liquid has fermented, and other such cases), the engaging state between the threaded sections can be prevented from locally deteriorating.

Therefore, the cap can be kept properly attached, preventing its hermeticity from decreasing.

Furthermore, since the strength of the threaded section can be made uniform in the circumferential direction, at the time of molding, and particularly at the time of peeling away the metal mold for inner surface from the cap, the mold for inner surface can be prevented from becoming tilted with respect to the cap, and the force applied against the threaded section in the peeling direction by the threaded section formation groove can be made to act evenly in a wide area in the cap circumferential direction.

For these reasons, the force in the peeling direction can be prevented from acting greatly on the cap locally, preventing the threaded section from deforming.

Therefore, reduction in hermeticity caused by this deforming can be prevented.

Furthermore, since the divided threaded section, which is immediately below the divided threaded section at the nearest position to the top plate, and the divided threaded section, which is immediately above the divided threaded section at the farthest position from the top plate, are formed continuously, even when the pressure inside the container which the cap has been attached to has increased, the cylindrical section can be prevented from expanding and deforming.

Therefore, the cap can be kept properly attached, preventing its hermeticity from decreasing.

The invention claimed is:

1. A synthetic resin cap, comprising:

a cap body having a top plate and a cylindrical section extending downward from the periphery thereof and having, in an inner peripheral surface thereof, a threaded section that engages with a thread of a container opening; and a circular inner seal projection formed integrally with the cap body on an inner surface of the top plate and fitting into the container opening, wherein an angle of circumference along which the threaded section is formed is from 680° to 720°;

the threaded section is divided by dividing sections into a plurality of divided threaded sections each having substantially an equal circumferential formation angle;

the dividing sections are provided around an entire circumference of the threaded section at substantially equal intervals selected from 45° to 90° in the circumferential direction; and the divided threaded section which is immediately below the divided threaded section at the nearest position to the top plate and the divided threaded section which is immediately above the divided threaded section at the farthest position from the top plate are formed continuously by a connecting section which has substantially the same circumferential formation angle as that of the dividing sections.

2. The synthetic resin cap according to claim 1, wherein a circular opening edge seal projection that contacts an opening edge of the container opening is formed on the top plate, and, when the synthetic resin cap is attached to the container opening, the opening edge seal projection is made able to bend and be deformed in the expanding radial direction until it contacts the cap body.

3. A closing device, comprising:

a container having a container opening; and a synthetic resin cap fitted in the container opening and having:

a cap body having a top plate and a cylindrical section extending downward from a periphery thereof and having, in an inner peripheral surface thereof, a threaded section that engages with a thread of the container opening; and a circular inner seal projection formed integrally with the cap body on an inner surface of the top plate and fitting into the container opening, wherein an angle of circumference along which the threaded section is formed is from 680° to 720°;

the threaded section is divided by dividing sections into a plurality of divided threaded sections each having substantially an equal circumferential formation angle;

the dividing sections are provided around an entire circumference of the threaded section at substantially equal intervals selected from 45° to 90° in the circumferential direction; and the divided threaded section which is immediately below the divided threaded section at the nearest position to the top plate and the divided threaded section which is immediately above the divided threaded section at the farthest position from the top plate are formed continuously by a connecting section which has substantially the same circumferential formation angle as that of the dividing sections.

4. A container-filled beverage in which a beverage is filled inside a closing device comprising:

a container having a container opening; and a synthetic resin cap having:

a cap body having a top plate and a cylindrical section extending downward from a periphery thereof and having, in an inner peripheral surface thereof, a threaded section that engages with a thread of the container opening; and a circular inner seal projection formed integrally with the cap body on an inner surface of the top plate and fining into the container opening, wherein an angle of circumference along which the threaded section is formed is from 680° to 720°;

the threaded section is divided by dividing sections into a plurality of divided threaded sections each having substantially an equal circumferential formation angle;

the dividing sections are provided around an entire circumference of the threaded section at substantially equal intervals selected from 45° to 90° in the circumferential direction; and the divided threaded section which is immediately below the divided threaded section at the nearest position to the top plate and the divided threaded section which is immediately above the divided threaded section at the farthest position from the top plate are formed continuously by a connecting section which has substantially the same circumferential formation angle as that of the dividing sections.

5. A synthetic resin cap according to claim 2, further comprising a positioning protrusion protruded from the top plate on the outer surface side of the inner seal projection, and wherein the positioning protrusion contacts an opening edge of the container opening at the bottom face thereof.

6. The synthetic resin cap according to claim 1, wherein a formation angle of a top surface of the threaded section with respect to the top plate is from 20° to 45°.

7. The synthetic resin cap according to claim 1, wherein a protruding length of the inner seal projection is from 1 mm to 5 mm.

8. The synthetic resin cap according to claim 2, wherein the opening edge seal projection includes:

an erect cylindrical section which extends substantially vertically downward from the inner surface of the top plate; and an expanding cylindrical section which widens in diameter from a bottom edge of the erect cylindrical section.

9. The closing device according to claim 3, wherein:

a diameter of the inner seal projection gradually increases in a protruding direction thereof; and a maximum outer diameter of the inner seal projection is greater than an inner diameter of the container opening.

* * * * *